United States Patent [19]

Adam et al.

[11] 4,315,961

[45] Feb. 16, 1982

[54] PRODUCTION OF STRIKING SURFACES FOR MATCHES

[75] Inventors: Wilhelm Adam, Neu-Isenburg; Hannsjörg Ulrich, Erftstadt; Franz-Josef Dany, Erftstadt; Gerd Kalteyer, Erftstadt, all of Fed. Rep. of Germany

[73] Assignee: Hoechst Aktiengesellschaft, Fed. Rep. of Germany

[21] Appl. No.: 167,219

[22] Filed: Jul. 9, 1980

[30] Foreign Application Priority Data

Jul. 12, 1979 [DE] Fed. Rep. of Germany ..... 2928140

[51] Int. Cl.[3] ..... B05D 3/02

[52] U.S. Cl. ..... 427/385.5; 44/25; 44/48; 427/391; 427/393; 428/481; 428/503

[58] Field of Search ..... 427/385.5, 391, 393; 149/6, 29; 44/42, 45, 47, 25, 21, 48; 206/96, 137, 98; 106/273 N, 277; 428/481, 491, 528, 503, 530; 53/394, 395; 162/135

[56] References Cited

U.S. PATENT DOCUMENTS 2,863,751 12/1958 Ledaal ..... 149/29 X
3,441,456 4/1969 Uffner ..... 44/48 X

FOREIGN PATENT DOCUMENTS 2236817 7/1973 France .
595270 4/1978 U.S.S.R. .

*Primary Examiner*—Norman Morgenstern
*Assistant Examiner*—Thurman K. Page
*Attorney, Agent, or Firm*—Connolly and Hutz

[57] ABSTRACT

The invention relates to a process for making striking surfaces wherein red phosphorus, abrasive agents, and binders which are in the form of aqueous urea/formaldehyde or melamine/formaldehyde-condensates, are made into an aqueous suspension which is applied on to a striking surface substrate. More particularly, the suspension, based on the solid matter content of the condensates used as binder, is admixed with 5 to 20 weight %, calculated as solid matter, of an agent cross-linking the amine resin, the cross-linking agent being a polyester or copolymer produced by subjecting an acryl and/or methacryl ester to copolymerization with vinyl acetate in a ratio by weight of 1:9 to 9:1. A pH-value within the range 6.5 to 8.0 is established in the mixture, in the event of the cross-linking agent being a copolymer, or a pH-value within the range 7 to 11 is established, in the event of the cross-linking agent being a polyester.

11 Claims, No Drawings

PRODUCTION OF STRIKING SURFACES FOR MATCHES

The present invention relates to a process for making striking surfaces for matches, wherein an aqueous suspension is prepared from red phosphorus, one or more abrasive agents, such as glass powder or sand, one or more binders in the form of aqueous urea/formaldehyde or melamine/formaldehyde-condensate, and, if desired, one or more hardeners, such e.g. as ammonium chloride, fillers, e.g. $Fe_2O_3$, $MnO_2$, $Sb_2S_3$, and additional water for regulating the viscosity of the mixture. Nest, a striking surface substrate of paper, wood or cardboard is coated with the suspension so made, the coated substrate is subjected to heat treatment so as to dry it and condense and harden the binder forming part of the suspension.

The striking surface substrate normally has the suspension applied thereto by means of a brush or printing roller.

The suspension should combine in itself fluidity with brushability so that it can regularly be applied to the substrate in the form of a thin layer inasmuch as a fully dried up thick layer is liable to scale off or break.

Glue made from hides or bones, or gum arabicum, sometimes in admixture with gum tragacanth, are the binders which have long been used and partially continue to be used even to-date.

One of the serious adverse effects which have been encountered with striking surfaces prepared as described above resides in their instability to moisture, especially under tropical conditions, under which the striking surfaces are open to the attack of, and in the end destruction by, bacteria.

Numerous attempts have therefore been made to use binders which are based on urea or melamine/formaldehyde resins or polyvinyl chloride dispersions. Those binders which are based on polyvinyl chloride are indeed highly effective, but expensive.

Urea and melamine resins are also highly resistant to the action of bacteria, but striking surfaces made therewith are liable to become brittle and friable. In addition to this, the striking surfaces at best offer some inhibitory resistance to penetration by water or moisture.

Still further, the resins just described often fail to harden regularly and sticky or friable striking surfaces are indeed often obtained, depending on the red phosphorus used in each particular case.

The present invention now unexpectedly provides a process for making striking surfaces of reliably good quantity, irrespective of the particular red phosphorus used, wherein red phosphorus, one or more abrasive agents, binders which are in the form of aqueous urea/formaldehyde or melamine/formaldehyde-condensates and, if desired, hardeners and fillers are made into an aqueous suspension, the suspension is applied on to a striking surface substrate and the substrate is heat-treated, if desired, which comprises: admixing the suspension based on the solid matter content of the condensates used as binder, with 5 to 20 weight %, preferably 5 to 10 weight %, calculated as solid matter, of an agent cross-linking the amine resin, the agent being a polyester or copolymer produced by subjecting an acryl and/or methacryl ester to copolymerization with vinyl acetate in a ratio by weight of 9:1 to 1:9, the copolymer having optionally up to 20 weight %, based on the monomeric ester proportion, of acrylic acid or methacrylic acid polymerized thereinto.

It is preferable for the polyester to be used in the form of an aqueous solution and for the copolymer to be used in the form of an aqueous suspension or an aqueous/alcoholic solution, the weight percentages indicated above being based on the solid matter content of the urea or melamine/formaldehyde-condensates and on the solid matter content of the cross-linking agent. Next, an aqueous solution of ammonia, an organic amine or mineral acid, especially phosphoric acid, is added to the above mixture so as to establish a pH-value within the range 6.5 to 8.0, preferably 7 to 7.5, in the event of the cross-linking agent being a copolymer, or a pH-value within the range 7 to 11, preferably 9.2to 9.6, in the event of the cross-linking agent being a polyester. After this has been done, the mixture is applied to a striking surface substrate.

In those cases in which the pH-value is established by means of an organic amine, it is good practice to use a low-boiling organic amine, such e.g. as trimethylamine, triethyllamine, preferably dimethylethanol amine.

The striking surfaces should be dried and/or hardened by subjecting them to heat-treatment at about 90° to 130° C. over a period of about 5 minutes. Even those striking surfaces which have a relatively thick layer of the above mixture applied thereto are elastic and flexible and adhere well to substrates of wood, paper or card board. An adhesion-inducing or improving agent may additionally be incorporated with the present suspension for application to a substrate of plastics material. The ignitibility which can be rated as being "very good" is reduced to an insignificant extent only by moisture and water.

The following composition is, for example, typical of a suspension made in accordance with this invention:

- 25 to 50 weight % red phosphorus
- 2 to 5 weight % abrasive agent (e.g. glass or sand)
- 35 to 65 weight % binder in the form of "MADURIT VMW 69/1" (this is a registered Trade Mark of Cassella Aktiengesellschaft, Frankfurt/Main, Federal Republic of Germany) which is an about 45 weight % aqueous solution of a urea/formaldehyde-condensate;
- 1.5 to 15 weight % cross-linking agent in the form of "MOWILITH DM 56" (this is a registered Trade Mark of Hoechst Aktiengesellschaft, Frankfurt/Main, Federal Republic of Germany) which is an about 50 weight % aqueous dispersion of a copolymer consisting to an extent of more than 50 wgt. % of an acrylic acid ester and to an extent of less than 50 weight % of vinyl acetate, and having a setting temperature of −18° C.
- up to 10 weight % hardener, such as $NH_4Cl$, and
- up to 20 weight % filler, e.g. $Fe_2O_3$ or additional water regulating the viscosity of the suspension.

Useful melamine/formaldehyde-condensates comprise mono- or polynuclear methylolated melamines and mixtures thereof with a molar ratio of 1:1.3 to 1:6, of which the methylol groups are unetherified or partially or completely etherified with at least one mono- or polyhydric aliphatic alcohol having 1 to 6, preferably 1 to 4 carbon atoms, and which are partially or preferably completely miscible with water. The mono- or polyhydric aliphatic alcohol may be saturated or unsaturated and have its carbon chain interrupted by one or more ether bridges. Useful alcohols are more particularly: methanol, ethanol, n-propanol, iso-propanol, n-butanol, iso-butanol, n-pentanol, iso-pentanol, n-hexanol, iso-hexanol, allyl alcohol, ethylene glycol, propylene glycol, butane diols, such as butane diol-1,4, hexane diols, such as hexane diol-1,6, diethylene glycol, triethylene glycol, dipropylene glycol or glycerol, methanol being the preferred aliphatic alcohol. The melamine/formaldehyde-condensates which are preferably used are trimethylol melamine/trimethylether, hexamethylolmelamine/hexamethylether or pentamethylolmelamine/trimethylether.

The mono-or polynuclear methylolmelamines may also contain one or more of the modifying agents customarily used in the aminoplast chemistry, in proportions of about 2 to 20 weight %, based on the mono- or polynuclear methylolmelamine. These modifying agents comprise more particularly: sorbitol, sugar, lactam, such as ε-aminocaprolactam, methylenebisformamide, toluene sulfone amides, e.g. p-toluene sulfone amide. Needless to say, it is, however, not absolutley necessary for the methylolmelamines to be so modified.

The useful urea/formaldehyde-condensates comprise monomeric or polycondensed methylol compounds of urea with a molar ratio of urea/formaldehyde of 1:1 to 1:3, which may be wholly or partially etherified with the mono- or polyhydric aliphatic alcohols specified hereinabove. Mixtures of etherified or unetherified monomeric and/or polycondensed methylolated ureas as well as mixtures of the above melamine/formaldehyde-condensates with the above urea/formaldehyde-condensates can also be used.

The water-soluble polyester cross-linking the amine resin used as a cross-linking agent should preferably have an OH-number within the range 30 to 450, preferably 80 to 200, an acid number within the range 20 to 300, preferably 60 to 100, and a dynamic viscosity of 100 to 750 mPa . s, determined in a 50 weight % solution in butyl glycol. These are prior art polyesters which are made by polycondensation of divalent dicarboxylic acids and dihydric alcohols, if desired in the presence of minor proportions of tri- or polybasic (hydric) carboxylic acids and/or alcohols. It is also possible in the polycondensation reaction to use derivatives of the above carboxylic acids and alcohols, especially esters with lower alcohols, acid chlorides, anhydrides or lactones.

Useful dibasic carboxylic acids and derivatives thereof comprise e.g. phthalic acid, phthalic anhydride, isophthalic acid, terephthalic acid, tetrahydrophthalic acid, hexahydrophthalic acid, endomethylene-tetrahydrophthalic anhydride, hexachloroendomethylene-tetrahydrophthalic anhydride, succinic acid, glutaric acid, adipic acid, pimelic acid, suberic acid, azelaic acid, sebacic acid.

Useful unsaturated dibasic carboxylic acids or derivatives thereof are e.g. maleic anhydride, fumaric acid, itaconic acid, citraconic acid, mesaconic acid.

Glycols suitable for use in the production of the polyesters comprise e.g. ethylene glycol, propylene glycol-(1,2), propylene glycol-(1,3), butylene glycol-(1,2), butylene glycol-(1,3), butylene glycol-(1,4), diethylene glycol, dipropylene glycol, triethylene glycol, 1,5-pentane diol, 1,6-hexane diol, hexylene glycol (=2-methyl-2,4-pentane diol), neopentyl glycol (=2,2-dimethyl-1,3-propane diol).

By the incorporation of a minor porportion of a tri- or polybasic (hydric) carboxylic acid and/or alcohol, it is possible for the polyester to be branched or cross-linked. To this end, use can be made, for example, of trimethylol propane, trimethylol ethane, 1,2,6-hexane triol, glycerol or pentaerythritol.

Polyesters in which the polycarboxylic acid component consists wholly or partially of an aliphatic dicarboxylic acid, especially adipic acid, succinic acid, sebacic acid or azelaic acid, are particularly useful.

As already indicated above, it is possible for the polyester to be modified by means of a monocarboxylic acid. Concerned are polyesters which do not dry in the open air. The term "water-soluble" as used herein in connection with the polyesters denotes solubility of the polyester in water at a pH-value higher than 7.

A suitable polyester was, for example, prepared as follows:

148 kg of phthalic anhydride
219 kg of adipic acid
49 kg of maleic anhydride
155 kg of ethylene glycol and
68 kg of pentaerythritol were condensed over a period of 270 minutes, during which the temperature rose from 125° to 185° C. 65 kg of distillate of which 60 kg was water and 5 kg was ethylene glycol was obtained. The polyester was obtained in a yield of 574 kg. Practically 100 weight % thereof was solid matter (determined by heating a 1 g specimen for 1 hour to 140° C.). The polyester had an OH-number of 181, and acid number of 96 mg KOH/g, and a viscosity of 132 mPa . s, determined on a 50 weight % solution in butyl glycol.

The binder which should preferably be used in an about 45 wgt. % aqueous urea/formaldehyde-condensate (commercially available "MADURIT VMW 69/1"; this is a registered Trade Mark of Cassella Aktiengesellschaft, Frankfurt/Main, Federal Republic of Germany) and the cross-linking agent which should preferably be used is an about 50 weight % aqueous dispersion of a copolyer (commerically available under the designation "MOWILITH DM 56"; this is a registered Trade Mark of Hoechst Aktiengesellschaft, Frankfurt/Main, Federal Republic of Germany), the copolymer consisting to an extent of more than 50 weight % of an acrylic acid ester and to an extent of less than 50 weight % of vinyl acetate, and having a setting temperature of −18° C.

The following Examples illustrate the invention which is naturally not limited thereto.

EXAMPLE 1: (Comparative Example)

A mixture with a pH-value of 9.7 consisting of 33 weight % red phosphorus 3.5 weight % glasspowder (84% < 90 microns)
63.4 weight % aqueous urea/formaldehyde-condensate solution with a solid matter content of 45 weight % (MADURIT VMW 69/1, a product of Cassella Aktiengesellschaft, Frankfurt/Main) and
0.1 weight % $NH_4Cl$ was applied by means of a rough brush to a substrate of card board, dried and hardened for 5 minutes at 100° C.

The resulting striking surface was very irregular, friable and brittle.

EXAMPLES 2 to 5:

A composition the same as that described in Example 1 was admixed with a 50 weight % aqueous dispersion of a copolymer which consisted to an extent of more than 50% of an acrylic acid ester and to an extent of less than 50% of vinyl acetate. Based on the solid matter content of the urea/formaldehyde-condensate solution, the composition was more particularly admixed with 5, 10, 15 and 20 weight % proportions, respectively, of the above dispersion calculated as solid substance. The dispersion had a setting temperature of −18° C. (commercially available under the designation "MOWILITH DM 56", a product of Hoechst Aktiengesellschaft, Frankfurt/Main).

The resulting suspensions were treated to establish the pH-values indicated in the following Table, then brush-applied to a substrate of card-board and dried and hardened for 5 minutes at 100° C.

The usability of the striking surfaces obtained in each particular case is indicated in the following Table.

| Ex. No. | Wgt % of copolymer added | pH-value of suspension | Condition of striking surface | Evaluation |
|---|---|---|---|---|
| 2 | 5 | 7.0 | irregular brittle | just usable |
| 3 | 10 | 7.3 | regular slight brittleness | good |
| 4 | 15 | 7.5 | regular elastic fast | very good |
| 5 | 20 | 7.9 | regular elastic slightly loose | just usable |

EXAMPLES 6 to 9:

The suspension used in Examples 2 to 5 were admixed with red phosphorus which had a pH-value of 2.1 and naturally affected the pH-value of the suspension:

| Ex. No. | Wgt % of copolymer added | pH-value of suspension | Condition of striking surface | Evaluation |
|---|---|---|---|---|
| 6 | 5 | 3.0 | very brittle irregular | poor |
| 7 | 10 | 2.7 | brittle, almost regular | poor |
| 8 | 15 | 2.3 | very brittle, scaled off | poor |
| 9 | 20 | 2.0 | brittle, almost regular, friable | poor |

EXAMPLE 10:

A pH-value of 7.8 was established by means of ammonia water in the composition of Example 8. The striking surface made therewith was regular and elastic. Only on sharply bending it became it slightly brittle. It was rated as "good".

EXAMPLES 11 to 16:

A binder based on a melamine/formaldehyde resin was admixed with a polyester produced in the manner described herein. (This mixture is commercially available under the designation MADURIT VMW 82, a product of Cassella Aktiengesellschaft, Frankfurt/Main).

63 parts of the mixture so obtained was further admixed with 2 parts of glass powder (84% <90 microns) and 35 parts of red phosphorus.

The resulting suspension had a pH-value which varied within wide limits, depending on the origin of the phosphorus. In Examples 13 to 16, NaOH of 40% strength was used to establish higher pH-values for marking the optimum condensation conditions.

The suspension was then brush applied in a covering layer to card board and dried for 3 minutes at 120° C. The resulting striking surfaces were rated as indicated in the following Table.

| Ex. No. | pH-value of suspension | Brushability | Condition of striking surface | Evaluation |
|---|---|---|---|---|
| 11 | 5.5 | good | friable, irregular slightly sandy | practically useless |
| 12 | 7.6 | good | elastic, still slightly sandy | usable |
| 13 | 9.4 | good | elastic, regular not sandy | very good |
| 14 | 9.5 | good | elastic, very thin layer | good |
| 15 | 10.6 | satisfactory | slightly friable | just usable |
| 16 | 12,1 | poor | phase separation, very sandy | useless |

We claim:

1. In the process for making striking surfaces for matches, wherein
   red phosphorus,
   abrasive agents,
   a binder comprised of aqueous urea/formaldehyde or melamine/formaldehyde-condensates
   are made into an aqueous suspension, the suspension is applied on to a striking surface substrate and the substrate is heat-treated,
   the improvement which comprises: admixing the suspension, based on the solid matter content of the condensates used as binder, with 5 to 20 weight %, calculated as solid matter, of an agent cross-linking the amine resin, the cross-linking agent being a polyester which is the polycondensation product of divalent dicarboxylic acids and dihydric alcohols or derivatives of the said acids and alcohols, or copolymer produced by subjecting an acryl and/or methycryl ester to copolymerization with vinyl acetate in a ratio by weight of 1:9 to 9:1, the copolymer having optionally up to 20 weight % based on the monomeric ester proportion of acrylic acid or methacrylic acid polymerized thereinto; and establishing, in the resulting mixture, a pH-value within the range 6.5 to 8.0, in the event of the cross-linking agent being a copolymer, or a pH-value within the range 7 to 11, in the event of the cross-linking agent being a polyester.

2. The process as claimed in claim 1, wherein the aqueous suspension is used in admixture with 10 to 15 weight % of cross-linking agent.

3. The process as claimed in claim 1, wherein the copolymer is added in the form of an aqueous dispersion.

4. The process as claimed in claim 1, wherein the polyester is added in the form of an aqueous solution.

5. The process as claimed in claim 1, wherein a pH-value within the range 7 to 7.5 is established in the mixture having the copolymer therein.

6. The process as claimed in claim 1, wherein the pH-value is established by means of phosphoric acid.

7. The process as claimed in claim 1, wherein the cross-linking agent is an about 50 weight % aqueous dispersion of a copolymer consisting to an extent of more than 50 weight % of acrylic acid-2-ethylhexyl ester and to an extent of less than 50 weight % of vinyl acetate, the dispersion having a setting temperature of −18° C.

8. The process as claimed in claim 1, wherein the polyester has an OH-number of 30 to 450, an acid number of 20 to 300 and a dynamic viscosity of 100 to 750 mPa . s, determined in a 50 weight % solution in butyl glycol.

9. The process as claimed in claim 8, wherein the polyester has an OH-number of 80 to 200 and an acid number of 60 to 100.

10. The process as claimed in claim 1, wherein a pH-value within the range 9.2 to 9.6 is established in the mixture having the polyester therein.

11. The process as claimed in claim 1 wherein the polyester crosslinking agent includes a minor proportion of tri- or polybasic-carboxylic acids and/or alcohols.

* * * * *